US007252595B2

(12) United States Patent
Regev

(10) Patent No.: US 7,252,595 B2
(45) Date of Patent: Aug. 7, 2007

(54) SEMI AUTOMATIC AIR TEE

(75) Inventor: Shay Regev, Moshav Rishpon (IL)

(73) Assignee: Airtee Ltd., Moshav Rishpon (IL)

( * ) Notice: Subject to any disclaimer, the term of this patent is extended or adjusted under 35 U.S.C. 154(b) by 41 days.

(21) Appl. No.: 11/043,743

(22) Filed: Jan. 26, 2005

(65) Prior Publication Data

US 2005/0192110 A1 Sep. 1, 2005

Related U.S. Application Data

(63) Continuation-in-part of application No. PCT/IL04/00064, filed on Jan. 22, 2004.

(51) Int. Cl.
*A63B 69/36* (2006.01)

(52) U.S. Cl. ..... 473/135

(58) Field of Classification Search ..... 473/132–137
See application file for complete search history.

(56) References Cited

U.S. PATENT DOCUMENTS 2,051,253 A * 8/1936 Goehler et al. ..... 473/135
2,618,480 A * 11/1952 Williams ..... 473/135
2,643,883 A * 6/1953 Hogeberg ..... 473/135
4,741,537 A 5/1988 Adam ..... 473/135
5,016,886 A * 5/1991 Gould ..... 473/135
5,145,176 A 9/1992 Lipson ..... 473/135
5,643,096 A * 7/1997 Lowe ..... 473/135
5,662,526 A * 9/1997 Sutherlin ..... 473/135
5,916,033 A * 6/1999 Doherty ..... 473/135
6,120,383 A 9/2000 Brown ..... 473/135
6,666,776 B2 * 12/2003 Yamaguchi ..... 473/134

* cited by examiner

*Primary Examiner*—Steven Wong
(74) *Attorney, Agent, or Firm*—Ohlandt, Greeley, Ruggiero & Perle, L.L.P.

(57) ABSTRACT

A semi-automatic teeing device includes a cylindrical housing having a gas inlet port connectable to a gas pressure source; a removable cover for sealed engagement with the housing so as to define therewith a sealable container; a tee mounted within a central support portion of the cover; air-pressure-operated apparatus located within the container for moving the tee between an at-rest position, and a primed position in which the tee supports a practice golf ball at a useful height; and an air-pressure control, responsive to the presence of a practice golf ball on the tee, to substantially seal the container so as to activate the air-pressure-operated apparatus to move the tee from the at-rest position to the primed position and operative, upon removal of the ball from the tee, to release the air pressure within the container, thereby to permit the return of the tee to the at rest position.

20 Claims, 6 Drawing Sheets

SEMI AUTOMATIC AIR TEE

CROSS-REFERENCE TO CO-PENDING APPLICATIONS

The present invention is a continuation-in-part application of PCT/IL2004/000064 filed Jan. 22, 2004, entitled SEMI AUTOMATIC AIR TEE.

FIELD OF THE INVENTION

The present invention relates generally to aids in practicing the game of golf and, more specifically, to teeing devices for use in a driving range.

BACKGROUND OF THE INVENTION

Golf has been a very popular game for many years now. In addition to playing on an actual golf course, golfers wishing to improve their skills often practice at a driving range, especially when practicing their tee shots. Normally, practicing golfers must repeatedly bend or stoop down to select a ball and to set it on a tee for each practice shot. This can be tiring, and interrupts the golfer's rhythm in repeating his practice shots. Further, it makes a practice session take longer, a disadvantage from the point of view of the proprietor of the golfing range. Automatic teeing would bring significant advantage to all parties.

Numerous systems and devices for automatic teeing have been patented. U.S. Pat. No. 5,145,176 to Lipson discloses a "Pneumatically Operated Golf Ball Tee" in which the golf ball is levitated by a continuous, upward, positive air flow from a hole or tube in the practice station. Since, however, it is not possible to pneumatically support a golf ball without some rotation or positional oscillation of the ball, it does not provide the desired stable target for proper golf practice. U.S. Pat. No. 6,120,383 to Brown discloses an "Apparatus For Placing A Golf Ball On A Tee" using negative air pressure or vacuum to pick up and hold a golf ball on a practice tee and stand the tee and ball up for a practice shot. While fully automated, this apparatus employs a four way valve and intricate pneumatics to control its operation. It is likely to be complicated and costly in practice. Both systems require an air pump, which is likely to be noisy and not conducive to the concentration golfers require for practice and play.

U.S. Pat. No. 4,741,537 to Adam, entitled "Teeing Device" discloses an apparatus for semi-automatically teeing up golf balls utilizing very low air pressure in order to create a positive air pressure so as to elevate a hollow tee supported by and connected to a flexible, thin walled inflatable chamber located within a recess. A hollow tee, on which a ball is supported when the device is used, is affixed to a top portion of the chamber, by gluing or other permanent means.

The use of an inflatable chamber as proposed by Adam, causes a number of problems, among which are the difficulty of replacing the hollow tee, the difficulty of disassembly of the device for cleaning and maintenance, the tendency of the chamber to become flooded with water when used in outdoor ranges in wet climates and the inoperability of the device when even slightly flooded, and the additional difficulty of draining the chamber in order to render it usable. Furthermore, while Adam provides means for adjusting the height of the tee, access to the height adjustment means requires removal of the artificial turf beneath which the device is installed.

Adam also provides an air supply from beneath the chamber, such that the air supply is susceptible to the ingress of water. This arrangement also transmits noise due to the acoustic energy of the flowing air, which results in a less than aesthetically pleasing experience for a user.

SUMMARY OF THE INVENTION

The present invention seeks to provide a device for automatically positioning practice golf balls on a tee, which does not require the user to bend over to position the ball, which is both simple and inexpensive to implement, use and maintain, and which produces relatively little noise when in operation. It is also a goal of the present application to provide a system of automatic teeing devices for a plurality of driving stations operated by a single source positive air pressure, at a driving range.

In accordance with a preferred embodiment of the invention, there is provided a semi automatic teeing device for positioning practice golf balls which includes a hollow tee for a golf ball, made of flexible material and fabricated to substantially sealingly engage a golf ball seated thereon; a tee holder, substantially cylindrical and configured to allow the tee to be sealingly mounted therein; a cylinder sealingly surrounding the tee holder, adapted to permit the tee holder with the tee mounted therein to move vertically therewithin; and a cover with a vertical opening for housing the cylinder; wherein the tee holder has a raised position and a lowered position in the cylinder; when the tee holder is in the lowered position in the cylinder, a golf ball entering the opening of the cover will seat on the top of the tee; and the tee, the tee holder, the cylinder, and the cover are adapted, in the presence of a source of positive air pressure within a predetermined range of magnitude, to provide a force which, when a golf ball is seated on the tee, is sufficient to raise the tee holder and the tee with the golf ball seated thereon to the raised position in the cylinder without blowing the golf ball off of the tee.

In accordance with a further preferred embodiment of the invention, there is provided a semi automatic teeing device for positioning practice golf balls which includes a hollow tee for a golf ball, made of flexible material and fabricated to substantially sealingly engage a golf ball seated thereon; a tee holder, substantially cylindrical and configured to allow the tee to be sealingly mounted therein; a cylinder sealingly surrounding the tee holder, adapted to permit the tee holder with the tee mounted therein to move vertically therewithin; a cover with a vertical opening for housing the cylinder; and a housing having an air inlet port for introducing positive air pressure within a desired predetermined range of magnitude therein via at least one air conduit connected thereto, the housing adapted to engage the cover so that the housing, the cover, the cylinder, the tee holder, and the tee together form a substantially air-tight container when a golf ball is seated on the tee; wherein the tee holder has a raised position and a lowered position in the cylinder; when the tee holder is in the lowered position in the cylinder, a golf ball entering the opening of the cover will seat on the top of the tee; and the tee, the tee holder, the cylinder, the cover, and the housing are adapted, in the presence of a source of positive air pressure within the predetermined range of magnitude, to provide a force which, when a golf ball is seated on the tee, is sufficient to raise the tee holder and the tee with the golf ball seated thereon to the raised position in the cylinder without blowing the golf ball off of the tee.

Additionally in accordance with a preferred embodiment of the invention, the raised position of the tee holder is defined by the point of abutting of the tee holder with the cover.

Further in accordance with a preferred embodiment of the invention, the tee, the tee holder, the cylinder, and the cover are further adapted, in the presence of the source of positive air pressure within the predetermined range of magnitude, to provide a force which, when there is no golf ball seated on the tee, is not sufficient to raise the tee holder and the tee above the lowered position.

Additionally in accordance with a preferred embodiment of the invention, the device also includes a mechanical stop located in the wall of the cylinder which defines the lowered position, in the cylinder, of the tee holder with the tee mounted therein.

Further in accordance with a preferred embodiment of the invention, the cover includes a substantially horizontal driving surface which has an indentation configured to gravitationally direct a golf ball to the opening of the cover to seat on the tee.

Additionally in accordance with a preferred embodiment of the invention, the cover further includes a height adjustment mechanism adapted to adjust the height of the point of abutting of the tee holder and the cover.

In accordance with an additional preferred embodiment of the invention, there is provided a semi automatic teeing device for positioning practice golf balls which includes a cylindrical housing having a gas inlet port connectable to a gas pressure source, such as a fan or a blower; a removable cover for sealed engagement with the housing so as to define therewith a sealable container, the cover having formed therewith a central support portion and an opening; a tee mounted within the central support portion; air pressure operated apparatus located within the container for moving the tee between an at rest position, in which the tee is retracted within the container, and between a primed position in which the tee is upwardly extended relative to the container so as to protrude upwardly through the opening, thereby to support a practice golf ball at a height for driving by a user; and an air pressure control, responsive to the presence of a practice golf ball seated on the tee, to substantially seal the container so as to cause in increase in air pressure within the housing, thereby to activate the air pressure operated apparatus to move the tee from the at rest position to the primed position and operative, upon removal of the practice golf ball from the tee, to release the air pressure within the container, thereby to permit the return of the tee to the at rest position.

Furthermore, the air pressure operated apparatus preferably includes a tee holder movably mounted within the central support portion, and adapted to hold the tee, the tee holder being responsive to an increase in air pressure within the container, to move to a raised position so as to abut the cover, and being further responsive to a decrease in air pressure within the container to move to a lowered position; and wherein movement of the tee holder to the raised position causes a corresponding movement of the tee to the primed position, and movement of the tee holder to the lowered position causes a corresponding movement of the tee to the at rest position.

Additionally, the device preferably also includes a mechanical stop, arranged at any of a plurality of different, predetermined heights within central support portion, operative to determine the lowermost position of the tee holder and thus also of the tee with the central support portion.

Furthermore, the cover preferably includes a substantially horizontal driving surface which has an indentation configured to gravitationally direct a golf ball to the opening of the cover to seat on the tee, and includes a top layer of artificial turf.

The device preferably also includes a pressure limiting device arranged in association with the gas inlet port for limiting the pressure of an air flow entering the housing to within a predetermined pressure range.

Preferably, the device also includes an adjustable height positioning mechanism for positioning the tee with respect to the cover, when in the primed position.

In accordance with one embodiment of the invention, the adjustable height positioning mechanism includes a selectably rotatable bushing mounted in association with the opening formed in the cover and operative, in response to an axial rotation, to undergo a linear translation relative to the cover, in accordance with the direction of rotation, so as to relatively elevate or lower the tee with respect to the cover.

Alternatively, there is provided apparatus for operating the height positioning mechanism in response to an axial rotation of the tee.

In accordance with one embodiment of the invention, the tee is a hollow tee having a free end for seating a golf ball, and the air pressure control includes the hollow tee; wherein the free end of the hollow tee has formed thereat a lip which configured to sealingly seat thereon a golf ball so as to seal the interior of the device, thereby to facilitate the increase of pressure therewithin.

Alternatively, however, in accordance with a preferred embodiment of the invention, the air pressure control is responsive to the loading provided by the weight of a practice golf ball seated on the tee, to substantially seal the container so as to cause in increase in air pressure within the housing, thereby to activate the air pressure operated apparatus to move the tee from the at rest position to the primed position and is further operative, upon removal of the weight of the practice golf ball from the tee, to facilitate air flow through the device, thereby to permit the return of the tee to the at rest position.

In accordance with the present embodiment of the invention, the tee has a downward facing flange which is formed so as to define an opening therein and, the tee positioned such that the flange and the opening are disposed to face in a downward direction; the air pressure operated apparatus includes the tee holder, and the cylinder; and the air pressure control includes the tee; a liner arranged within the cylinder, having a web portion arranged to face the flange so as to selectably seal the opening; and a resilient member disposed between the tee holder and the liner, operative, when in an at rest position, to push apart and separate the tee holder and the liner, thereby to not obstruct the flow of air through the opening. In operation, when the device is in the at rest position, such that the tee holder and the tee ate in the lowermost position, the liner rests on the mechanical stop so as to be prevented from further downward movement relative to the tee holder, and in response to a predetermined loading on the tee holder, such as may be provided by the weight of a golf ball seated on the tee, the tee holder is operative to move towards the liner, contrary to the urging of the resilient member, such that the flange is forced into touching contact with the we portion of the liner, thereby to substantially obstruct the flow of air through the opening, and thus cause an increase in pressure within the device, and operation of the air pressure operated apparatus to move the tee from the at rest position to the primed position.

In accordance with a further preferred embodiment of the invention, the hollow tee, the tee holder and the cylinder are supported by the cover, so as to be removable from the housing together therewith.

Furthermore, the cover is preferably formed with an upwardly extending rim, thereby to prevent the ingress of surface water into the interior of the container, up to a depth corresponding to the height of the rim.

In accordance with yet a further preferred embodiment of the invention there is also provided apparatus for minimizing noise produced by the air flow within the housing. Most preferably, the noise reduction apparatus is inherent in the construction of the air inlet port which is configured to direct an air flow into the housing in a manner that minimizes the noise produced thereby, preferably in a generally radial direction.

In accordance with yet one further embodiment of the invention, there is provided a golf practice driving range having a teeing system which includes a plurality of semi automatic teeing devices for positioning practice golf balls as described herein, a gas pressure source, preferably a fan or blower; and a plurality of conduits for providing an air supply to each of the plurality of semi automatic teeing devices, at a required pressure.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
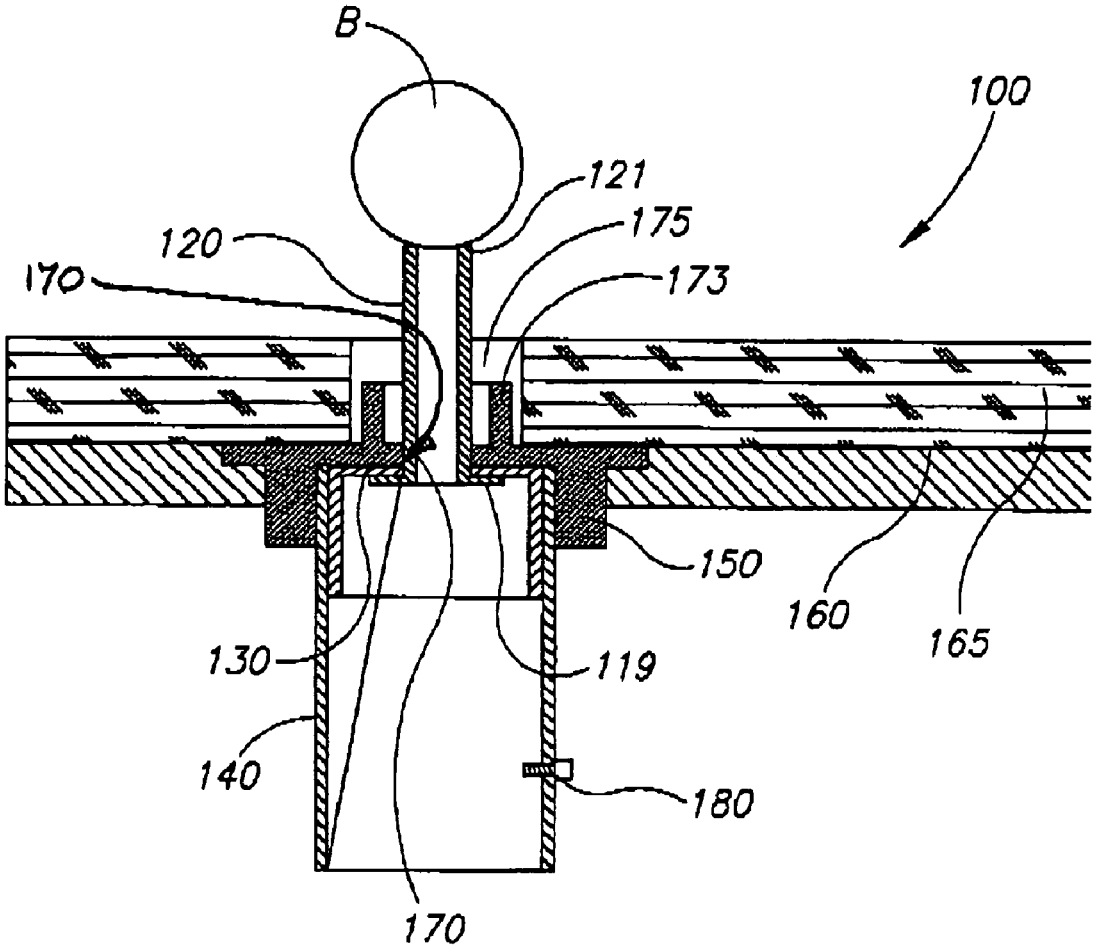
FIG. 1 is a schematic side view of a teeing device constructed and operative in accordance with an embodiment of the present invention, in its raised position.
Figure 2:
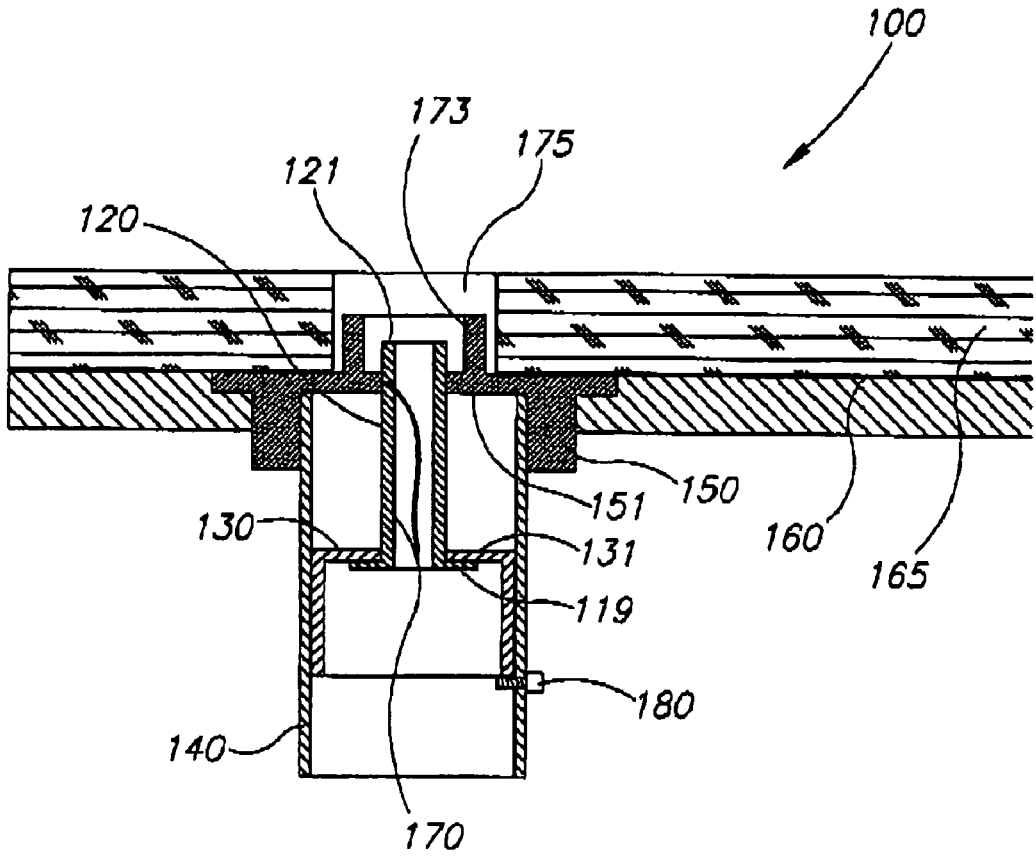
FIG. 2 is a schematic side view of the device of FIG. 1, in its lowered position.

Referring now to FIGS. 1 and 2, there is shown a schematic side view of a teeing device, referenced generally 100, constructed and operative in accordance with a preferred embodiment of the present invention. Device 100 as shown is operative to seat a golf ball B (FIG. 1) on a flexible, hollow tee 120, a bottom flange of which, referenced 119, is connected to and supported by a tee holder 130, enclosed by a cylinder 140. It will be appreciated that in the present embodiment, axial movement of tee holder 130 within cylinder 140 causes a corresponding movement of tee 120.

Cylinder 140 fits within a cover 150, whose upper surface terminates in a driving surface 160 which may be covered by artificial turf 165 or, alternatively, by real grass. Cover 150 has an opening 170 through which tee 120 protrudes so as to support golf ball B at a desired height for practicing tee shots. As seen in the drawing, there is a provided a rim 173 surrounding the opening 170, which is operative to reduce the likelihood of the ingress of rainwater through opening 170, into device 10.

In accordance with the present embodiment, golf ball B, tee 120, and tee holder 130 are elevated to the illustrated raised position and supported thereat by a source of positive air pressure introduced into cylinder 140 by suitable means. Tee 120 is fabricated of any suitable flexible and resilient material such as rubber that can endure repeated impacts from golf clubs as a golfer practices hitting golf balls B off the tee. Tee 120 must also be flexible enough and its upper lip 121 must be formed so that when golf ball B is seated thereon, as illustrated in FIG. 1, it forms a substantially air-tight seal therewith. This enables the air pressure within cylinder 140, tee holder 130, and tee 120 to build to above atmospheric pressure, thereby to generate a pressure force adequate to raise tee holder 130, tee 120, and golf ball B from the lowered position illustrated in FIG. 2, to the raised position shown in FIG. 1. In the raised position, an upper surface 131 of tee holder 130 abuts a lower surface 151 of cover 150, and tee 120 is located at its uppermost position relative to driving surface 160, so as to position golf ball B in a suitable position above driving surface 160 for a golfer to make a practice shot.

After the golfer hits the ball off tee 120, air flows freely out of cylinder 140 via the bore of hollow tee 120 so as to release the air pressure within the device, thereby permitting tee holder 130 and tee 120 to fall within cylinder 140, under their own weight, to their lowermost position, as shown in FIG. 2. The lowermost position thereof is determined by a mechanical stop 180, fastened in the side wall of cylinder 140.

In accordance with a preferred embodiment of the invention, the indented region 175 in driving surface 160 is large enough for the golfer to direct a new golf ball thereinto with a golf club, without having to bend over. In a further preferred embodiment of the present invention, the indented region may have a larger geometry sloping into the opening 170 of cover 150 to further facilitate directing golf balls thereinto. The present invention may further be integrated with automatic golf ball feeders such as are known in automatic teeing systems employed in the prior art. Once a new golf ball enters opening 170 in cover 150, as it seats on tee 120, the air flow through tee 120 will be blocked, and the pressure therein will increase, as shown and described hereinabove. With the air flow stopped as tee 120 engages the golf ball, the increased air pressure will produce sufficient force to raise tee holder 130, tee 120, and the new golf ball to the raised position, as shown in FIG. 1.

It will be appreciated by persons skilled in the art, that the positive air pressure supplied to teeing device 100 and specifically introduced into cylinder 140 must be regulated so that its magnitude will fall within a desired range for the teeing device to perform as described hereinabove. Specifically, the pressure must be great enough to provide a force, when the bore of tee 120 is closed off by a golf ball B, to lift tee holder 130, tee 120, and golf ball B, without blowing golf ball B off tee 120 when tee holder 130 reaches its uppermost position in cylinder 140, as shown in FIG. 1. Further, when there is no golf ball on tee 120, as shown in FIG. 2, the residual air pressure in cylinder 140 when air flows unobstructed through the bore of tee 120, must never provide a force strong enough to raise tee holder 130 and tee 120 from their lowermost position in cylinder 140, as defined by mechanical stop 180.

In practice, the inventor has been able to meet these criteria using a fan as a source of positive air pressure and a flow control valve to regulate the pressure in a teeing device constructed and operative in accordance with an embodiment of the present invention. It should, however, be noted that the use of fan and valve are presented by way of example, and other means of providing positive air pressure and regulating it so that its magnitude will be within the desired range should also be considered as being within the scope of the present invention. It should be noted that while thin-gauge conduits for gas flow limit gas flow in and of themselves, they do not limit transfer of pressure when there is no flow. In the present invention, this applies to the conduits connecting the pressure source via the regulating valve to the teeing device as well as to the hollow tee itself. This serves to facilitate provision of adequate pressure to provide the requisite lifting force when there is a golf ball on the tee, as well as limiting the lifting force as required in the case where there is no golf ball on the tee.

It should further be noted that use of a fan as a pressure source in the present invention, as opposed to use of an air compressor, which nonetheless should also be considered an embodiment of the present invention, has an added advantage of relatively quiet operation, thereby providing a relatively quiet environment for the golfer to practice therein.

Figure 3A:
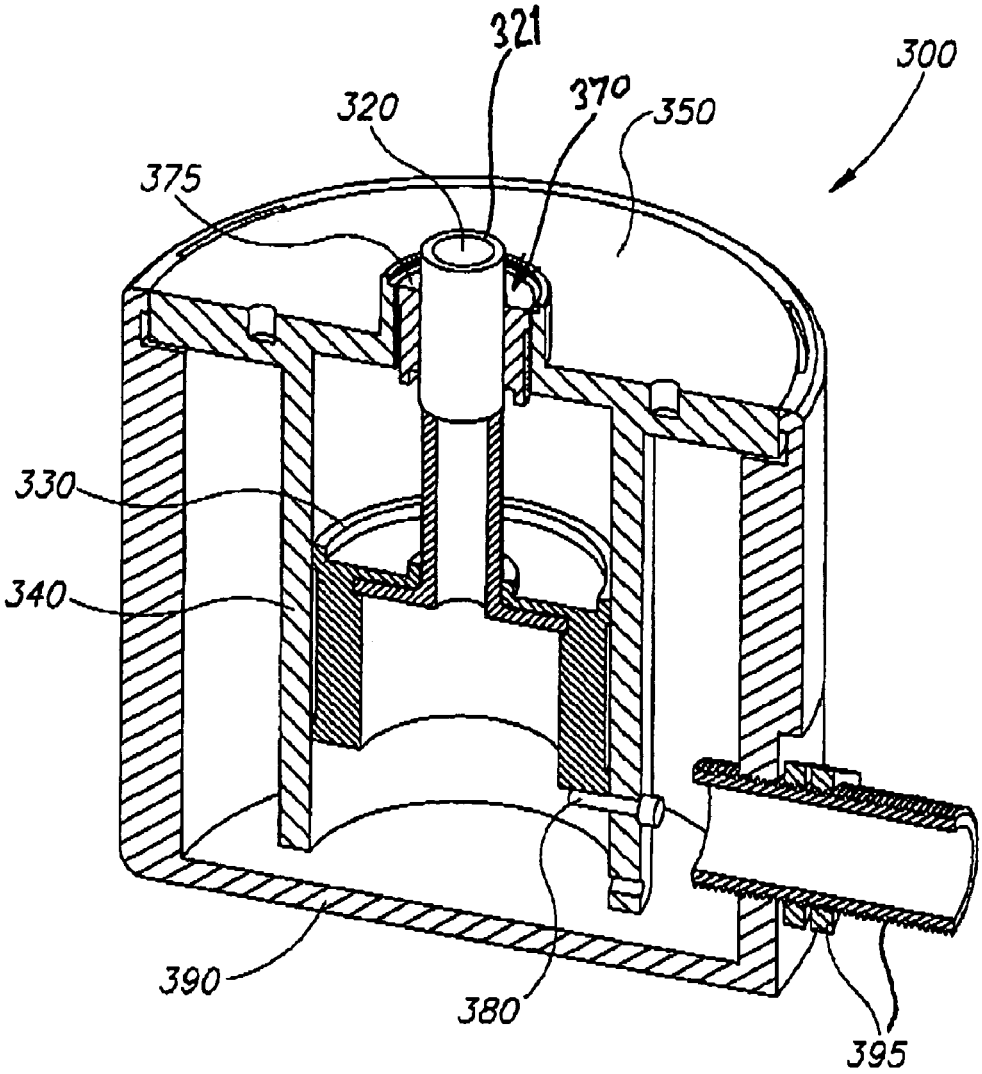
FIG. 3A is a cross-sectional side view of a teeing device constructed and operative in accordance with an alternative embodiment of the present invention, seen in an at rest position.
Figure 3B:
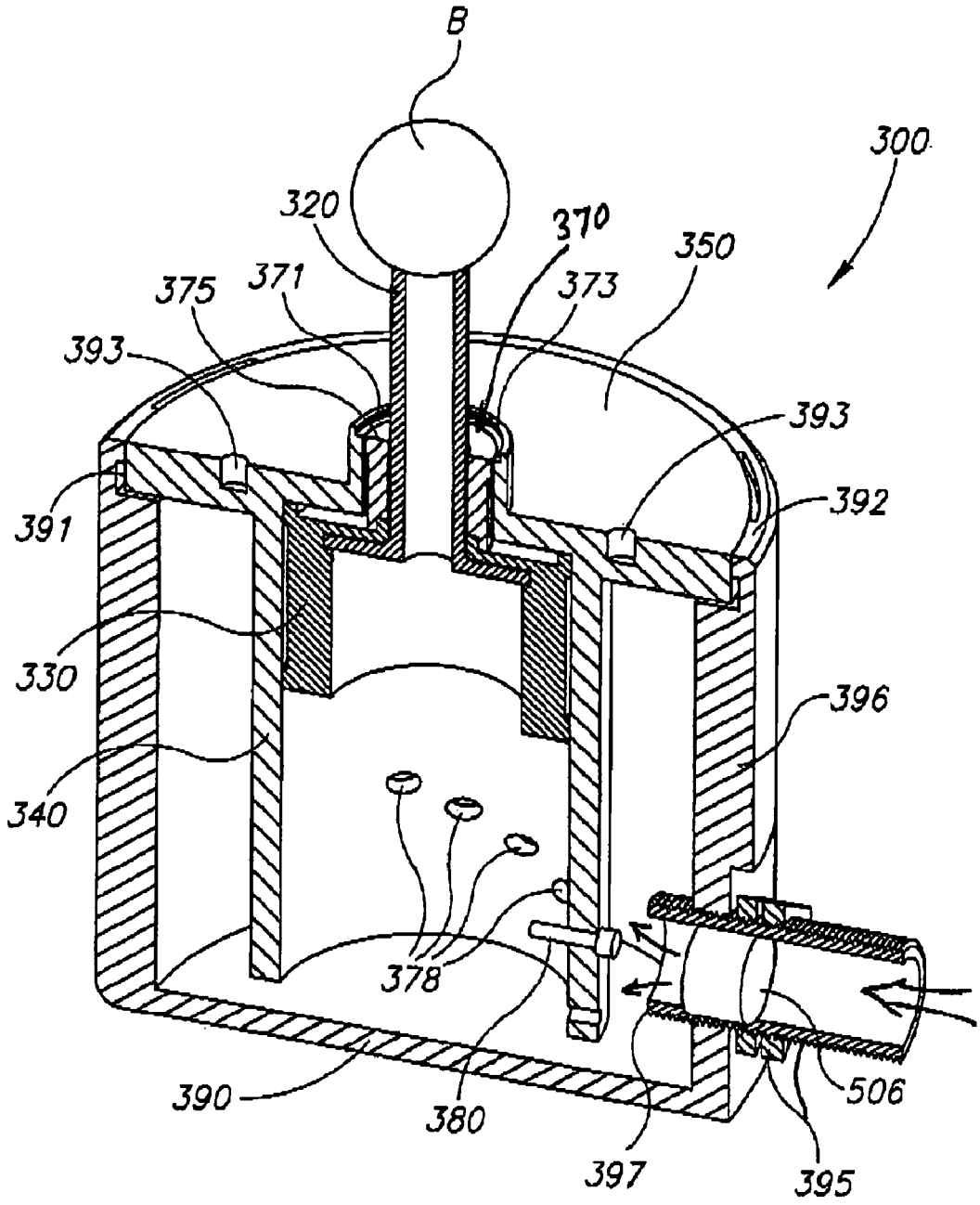
FIG. 3B is a cross-sectional side view of the teeing device of FIG. 3B, seen in a primed position.

Referring now to FIGS. 3A and 3B, there is shown a cross-sectional side view of a teeing device, referenced generally 300, constructed and operative in accordance with an alternative embodiment of the present invention as a sealable, fully integrated unit. For the sake of conciseness, features common to the present embodiment and that discussed hereinabove with respect to FIGS. 1 and 2 are not specifically described a gain herein, except as may be required for an understanding of the present embodiment. Device 300 is, as described, a sealable, fully integrated unit which is formed of a rigid cylindrical housing 390, and a removable cover 350 which fits sealingly together with housing 390. Formed integrally with cover 350 is a preferably cylindrical, central support portion 340, extending downwardly into the interior of housing 390; and an upwardly extending cylindrical rim 373, similar to rim 173 as shown and described above in conjunction with FIGS. 1 and 2. It will be noted that cylindrical, central support portion 340 is variously and interchangeably referred to herein both as "cylinder" and "cylindrical central support portion," and "central support portion."

Housing 390 is has formed therein a gas inlet port 395 which may be attached, via one or more air conduits, to a suitable source of positive gas pressure, as described hereinabove with respect to FIGS. 1 and 2, and as shown schematically in FIG. 4 at reference numeral 500. Preferably, the gas pressure source is an air pressure source. As described above, housing 390 engages removable cover 350 to form, together with air pressure operated means constituted by cylinder 340 and tee holder 330, and an air pressure control constituted by hollow tee 320, a largely air-tight container, when a golf ball B is seated on the lip 321 (FIG. 3A) formed at the free end of tee 320.

In accordance with a preferred embodiment of the invention, there is further provided an adjustable height positioning mechanism for positioning cylinder 340, tee holder 330, and tee 320, within cover 350. Preferably, the adjustable height positioning mechanism is constituted by a threaded bushing 375, which is formed to threadingly engaging an inward-facing threaded surface 371 of rim 373.

It will thus be appreciated that rotation of the threaded bushing 375 along threaded surface 371 causes a relative linear translation therebetween, in accordance with the direction of rotation, so as to relatively elevate or lower the tee holder 330 and thus also tee 320 with respect to cover 350 thus adjusting the height at which tee holder 330 abuts threaded bushing 375, and thus the height of teed golf ball B as it sits on tee 320 in the primed position.

Alternatively, and in accordance with a further embodiment of the invention, the entire teeing assembly, namely, threaded bushing 375, tee holder 330, and tee 320 may advantageously be fabricated to selectably interlock. The advantage of this is that threaded bushing 375 may be rotated, and thus the adjustable height positioning mechanism may be operated, simply by an axial rotation of tee 320. A particular advantage of this is that the height may thus be adjusted without disassembly of the device or the use of tools of any kind.

It should be noted that threaded bushing 375 is presented by way of example, and any other suitable height adjustment mechanism should also be considered as being within the scope of the present invention.

Removable cover 350 is preferably fastened to cylindrical housing 390 by means of a helical thread 391 formed on an upper inner rim 392, and may be screwably attached to or detached from the housing, as desired, to gain access to the teeing assembly or to the interior of the housing 390, for the purpose of cleaning or maintenance. In order to assist in the rotation of cover 350 for this purpose, it may have formed therein two or more shaped recesses 393, arranged for engagement by a suitably shaped wrench (not shown).

It will also be noted that, as seen in FIG. 3B, there may be provided a plurality of apertures 378 for stop 380, arranged at any of a plurality of different, predetermined heights within cylinder 340, so as to predetermine the lowermost position of tee holder 330 and thus also of tee 320. Adjustment of this lowermost position may be done at the time of installation or, if necessary, subsequent thereto, upon removal of the cover 350, and the transfer of stop 380 from one aperture 378 to another at a more suitable height.

It will be appreciated that a major advantage of the present invention is its simplicity of construction for the purpose of maintenance and cleaning. In particular, as the teeing assembly is mounted in the cover 350, removal of the cover from the housing enables immediate access to any of the components of the teeing assembly, and removal from the housing, by use of a cloth or the like, of any dirt or water that may have succeeded in entering into the housing, without having to further disassemble the device.

Yet a further advantage of the present invention is the provision of rim 373, which serves to prevent the ingress of rainwater into the interior of the device, should the driving range become flooded to a depth not exceeding the height of the rim.

Further protection against the ingress of water into the device is provided by the positioning of the gas inlet port 395. As seen, the inlet port 395 is formed in the cylindrical sidewall 396 of the housing 390, and so as to have a generally radial orientation. The effect of this radial orientation is to cause an inward airflow which is also initially radial. Accordingly, in the event that water does succeed in entering the interior of the device, which, in most rain conditions will normally not occur due to the provision of the rim 373 and bushing 375, it will not penetrate into the air supply until accumulation of a depth which exceeds the lip 397 of port 395.

It will also be appreciated by persons skilled in the art that the device will operate as long as there is a sufficient pressure head within the housing, and as long there is no obstruction to the return of tee holder 330 to its lowermost position. Accordingly, the accumulation of a small amount of water in the device, as described, will not impede the operation of the device, in any way.

It has further been found by the Inventor, that the provision of a radial air flow into the cylindrical housing 390, causes a muffling effect vis-a-vis the acoustic energy of the air flow, thereby resulting in a relatively quiet operation of the device, and a pleasant experience for a user. This is a significant improvement over the prior art, as exemplified for example by U.S. Pat. No. 4,741,537 to Adam, in which there is provided an axial air flow through the floor of the device, which results in significant noise during operation thereof.

It will thus be appreciated that operation of the device 300 is as follows:

In an initial position, seen in FIG. 3A, the device is 'at rest', no ball is placed on tee 320 and the teeing assembly is fully retracted, and supported at its lowermost position as the lower edge of cylinder 330 rests on stop 380. Subsequently, and referring now also to FIG. 3B, placement of a ball B onto the top edge of tee 320 serves to seal the tee 320 in its capacity as an air pressure control, which causes the entire device 300 to be sealed.

Pressure then builds within the teeing device 300, in response to which the air pressure operated means constituted by cylinder 330 and tee holder 330 becomes elevated so as to raise the tee 320 to its 'primed' position seen in FIG. 3B, so as to position the ball B at a height which is convenient for a golfer to strike it. After the golfer strikes the ball so as to dislodge it from the end of the tee 320, the air pressure control constituted by the hollow tee 320, permits pressurized air within the device to escape, after which the teeing assembly returns to its retracted, at rest position, seen in FIG. 3A, under its own weight.

Figure 4:
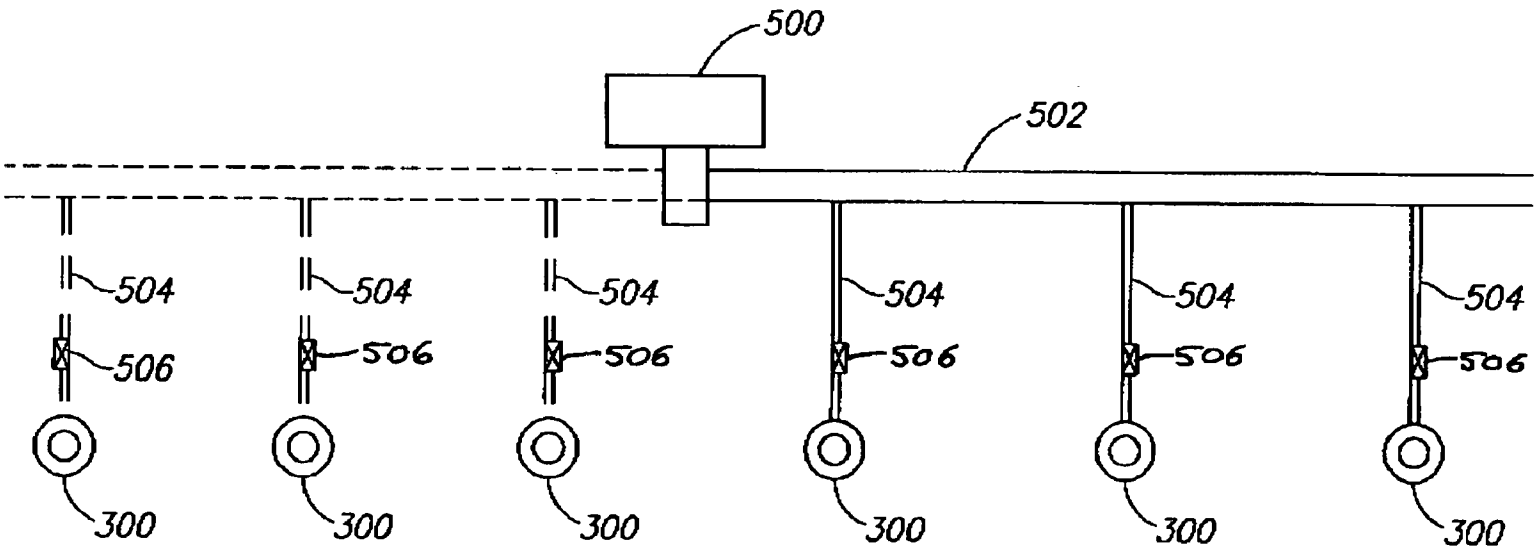
FIG. 4 is a diagrammatic representation of a golf practice driving range incorporating a teeing system formed of a plurality of centrally driven teeing devices of the present invention

Referring now briefly to FIG. 4, there is shown, in diagrammatic form, a representation of a driving range incorporating a teeing system formed of a plurality of centrally driven teeing devices 300 of the present invention. The teeing system includes a gas pressure source 500, such as a suitable fan or blower, to which a predetermined plurality of teeing devices 300 are attached via a main supply conduit 502 and a plurality of branch conduits 504. The branch conduits are connected to each teeing device in parallel, so as to provide a required low pressure air supply thereto, substantially independently of the operation of the other teeing devices 300. Tests have been performed by the inventor demonstrating that twenty teeing devices may be connected in parallel, although a greater number than this may also be connected to a single pressure source, for operation as described.

According to one embodiment of the invention, each teeing device 300 must receive air at a pressure which is sufficient to lift the teeing assembly with a ball placed on the end of the tee, but not so great as either to blow the ball off or raise the teeing assembly when no b all is located on the tee. The precise pressure range will be determined on site, in accordance with a number of different parameters, including the precise dimensions of the teeing device, the materials from which it is made, the overall layout of the range, the length and the dimensions of the main supply conduit and branch conduits.

In accordance with a preferred embodiment of the invention, each teeing device 300 has associated therewith either a flow limiting device, such as a suitable valve or, more preferably, a pressure limiting device of any suitable type, in order to limit the pressure of the air flow entering the housing 390 to a predetermined pressure range within which the device 300 will operate properly, but wherein a ball will not be blown off the tee 320, inadvertently, by the air pressure. Such devices, referenced 506, may be located upstream of the gas inlet port 395 (FIG. 3A), as shown in FIG. 4, or may be incorporated into the inlet port 395 itself, as seen schematically in FIG. 3B.

Figure 5A:
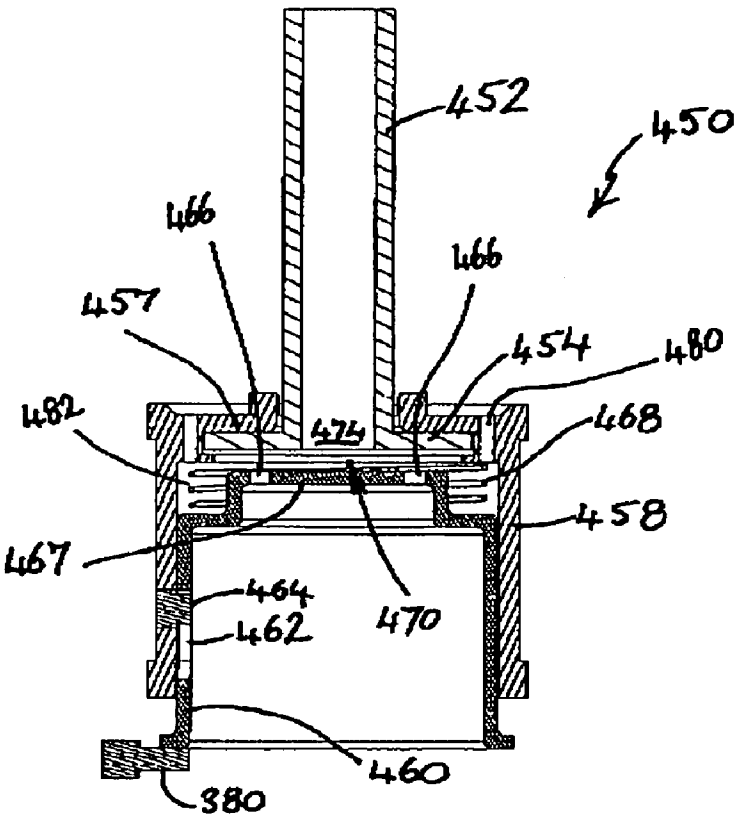
FIG. 5A is a detailed cross-sectional side view of a ball-operated air pressure control, seen in an open position, constructed and operative in accordance with an alternative embodiment of the invention.
Figure 5B:
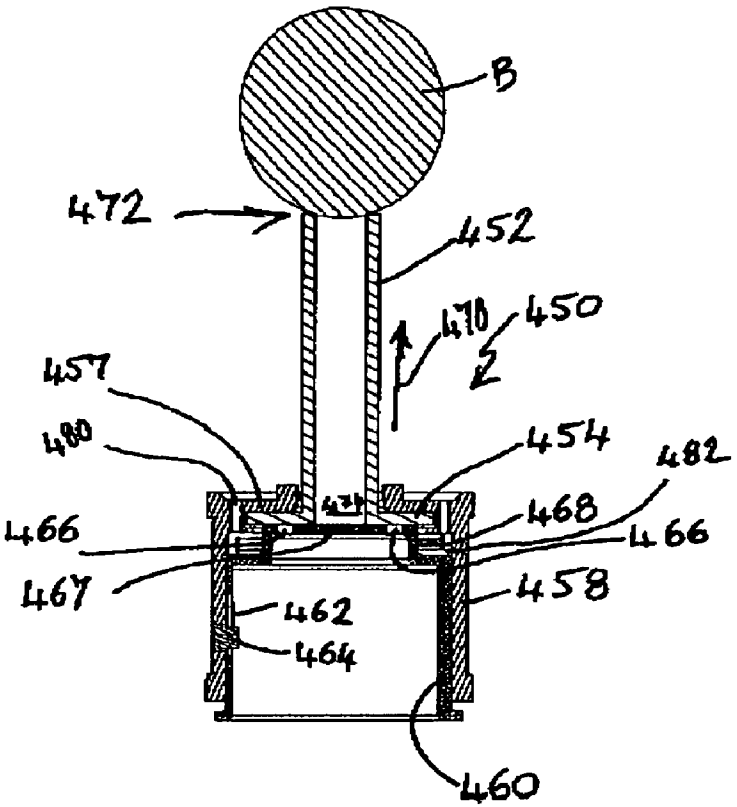
FIG. 5B is a detailed cross-sectional side view of the ball-operated air pressure control of FIG. 5A, seen in a closed position.

Referring now to FIGS. 5A and 5B, there is shown a ball-operated air pressure control, referenced generally 450, for use in teeing device 300, constructed and operative in accordance with an alternative embodiment of the invention. The control 450 is seen in an open position in FIG. 5A, and a closed position in FIG. 5B.

Referring briefly to device 300 of FIGS. 3A and 3B, the operation of the device as shown and described above, in which the tee also serves as the air pressure control, is dependent on obtaining a reasonably high quality seal between the golf ball and the top end or lip of the tee 320. While this is of course feasible, it has been found that repeated striking of the tee 320 by a golf club, as well as drying out of the rubber material from which the tee may be made, can cause damage to the tee, so as to reduce the effectiveness of the seal with the golf ball, and requiring replacement of the tee at regular intervals.

The present embodiment of the invention thus represents a further improvement, in which the weight of the golf ball is used to operate control 450 so as to seal the teeing device, but, as distinct from the previous embodiments, wherein the golf ball itself does not form part of the seal.

In the illustrated embodiment, there is provided a hollow tee 452 which has a lower end flange 454 secured to the underside of web portion 457 of tee holder 458. Tee holder 458 acts within cylinder 340 (FIGS. 3A and 3B) in the same way as described in conjunction with FIGS. 3A and 3B, and is thus not specifically described herein, except as may be required for an understanding of the operation of control 450.

A liner, referenced 460, illustrated herein by way of example as having a cup shape, is positioned within tee holder 458, and is adapted for limited, axial sliding motion therewithin. The lower limit of the movement of liner 460 relative to tee holder 458 is defined by means of a slot 462 formed therein, into which protrudes a protuberance 464, mounted in the side wall of tee holder 458, as shown. The lower limit of both the tee holder 458 and of the liner 460 therewith, is defined by stop 380 (FIG. 5A) which is as substantially as seen and described in relation to FIGS. 3A and 3B, and sufficiently long so as to act as a stop also to liner 460. Web portion 467 of liner 460 is formed with a plurality of air flow apertures 466, for permitting the escape of air from the interior of the teeing device, when apertures 466 are not blocked.

There is also provided a resilient member 468, such as a compression spring, which is disposed between liner 460 and tee holder 458. The strength of resilient member 468 is selected such that when in an at rest position, corresponding to the position of device 300 as shown and described above in conjunction with FIG. 3A, resilient member 468 it pushes apart tee holder 458 and liner 460, so as to separate them, and such that liner 460 is located at its lowermost position with respect to tee holder 458, and rests on stop 380. This position is illustrated in FIG. 5A, in which air flowing into the teeing device flows directly out of hollow tee 452, via apertures 466 formed in liner 460, a space 470 defined between lower end flange 454 of tee 452 and web portion 467 of liner 460, and lower opening 474 of tee 452.

Referring now also to FIG. 5B, the placement of a ball B onto the free end 472 of tee 452 causes a loading onto tee holder 458 equal to the weight of the ball, counter to resilient member 468, and sufficient to cause a relative closure of tee holder 458 onto liner 460, while compressing resilient member 468 therebetween. The movement of tee holder 458 relative to liner 460, which is held against stop member 380 as seen in FIG. 5A, terminates as flange 454 of tee 452 becomes pressed against the web portion 467 of liner 460. Whereas previously the air flow from within device 300 generally (FIGS. 3A and 3B) and liner 460 specifically, would exit the device 300 by passing through apertures 466 and lower opening 474 of tee 452, in the present position, these openings are closed; apertures 466 are closed by flange 454, and lower opening 474 of tee 452 is closed by web position 467 of liner 4 60. This thus prevents the escape of air from the interior of the teeing device, thereby causing an increase of air pressure therewithin.

For the sake of clarification, it will be appreciated that the operative position of the teeing device at this point, corresponds to that illustrated in FIG. 3A, in which the tee 320 of teeing device 300 is fully retracted within housing 390, and liner 460 and tee holder 458 are supported on stop 380.

Referring now to FIG. 5B, as the pressure within the teeing device increases, the liner 460, tee holder 458 and tee 452 connected thereto, are pushed upwards, as indicated by arrow 478, into a primed position as exemplified in FIG. 3B with teeing device 300.

Subsequently, as the loading applied to the tee holder 458 by the weight of the ball is removed as the ball B is hit, the resilient member 468 is operative to expand so as to push apart the tee holder 458 and liner 460, thereby opening apertures 466 and opening 474, so as to permit an escape of excess pressure from the interior of the device.

In accordance with a preferred embodiment of the invention, tee holder 458 has formed therein one or more vents 480, which connect between the cavity 482 housing the resilient member 468, and the exterior of the tee holder 458. The provision of vents 480 ensures pressure equalization within the control 450, and consequent proper operation thereof.

It will be appreciated by persons skilled in the art that in the present embodiment of the invention it is not the sealing between ball B and the free end 472 of the tee 452 that is instrumental in operation of the device, but the activation of the control 450 in response to the weight of the ball. Accordingly, in accordance with alternative embodiments of the control of the invention, the tee 452 does not necessarily have to be hollow, as long there is provided an alternative pressure relief valve which is connected with the interior of the teeing device, and which may be sealed solely by the action of the tee in response to placement thereon of a ball.

It will further be appreciated by persons skilled in the art that the scope of the present invention is not limited by what has been specifically shown and described hereinabove, merely by way of example. Rather, the scope of the present invention is defined solely by the claims, which follow.

The invention claimed is:

1. A semi automatic teeing device for positioning practice golf balls which includes: a hollow tee for a golf ball, made of flexible material and fabricated to substantially sealingly engage a golf ball seated thereon; a tee holder, substantially cylindrical and configured to allow said tee to be sealingly mounted therein; a cylinder sealingly surrounding said tee holder, adapted to permit said tee holder with said tee mounted therein to move vertically therewithin; and a cover with a vertical opening for said tee; wherein said tee holder has a raised position and a lowered position in said cylinder; wherein, when said tee holder is in said lowered position in said cylinder, a golf ball entering said opening of said cover will seat on said top of said tee; and wherein said tee, said tee holder, said cylinder, and said cover are adapted, in the presence of a source of positive air pressure within a predetermined range of magnitude, to provide a force which, when a golf ball is seated on said tee, is sufficient to raise said tee holder and said tee with the golf ball seated thereon to said raised position in said cylinder without blowing the golf ball off of said tee.

2. A teeing device according to claim 1, wherein said raised position of said tee holder is defined by the point of abutting of said tee holder with said cover.

3. A teeing device according to claim 1, wherein said tee, said tee holder, said cylinder, and said cover are further adapted, in the presence of the source of positive air pressure within said predetermined range of magnitude, to provide a force which, when there is no golf ball seated on said tee, is not sufficient to raise said tee holder and said tee above said lowered position.

4. A teeing device according to claim 1, further including a mechanical stop located in the wall of said cylinder which defines said lowered position, in said cylinder, of said tee holder with said tee mounted therein.

5. A teeing device according to claim 1, wherein said cover includes a substantially horizontal driving surface which has an indentation configured to gravitationally direct a golf ball to said opening of said cover to seat on said tee.

6. A teeing device according to claim 2, wherein said cover further includes a height adjustment mechanism adapted to adjust the height of said point of abutting of said tee holder and said cover.

7. A semi automatic teeing device for positioning practice golf balls which includes: a hollow tee for a golf ball, made of flexible material and fabricated to substantially sealingly engage a golf ball seated thereon; a tee holder, substantially cylindrical and configured to allow said tee to be sealingly mounted therein; a cylinder sealingly surrounding said tee holder, adapted to permit said tee holder with said tee mounted therein to move vertically therewithin; a cover with a vertical opening for said tee; and a housing having an air inlet port for introducing positive air pressure within a desired predetermined range of magnitude therein via at least one air conduit connected thereto, said housing adapted to engage said cover so that said housing, said cover, said cylinder, said tee holder, and said tee together form a substantially air-tight container when a golf ball is seated on said tee; wherein said tee holder has a raised position and a lowered position in said cylinder; wherein, when said tee holder is in said lowered position in said cylinder, a golf ball entering said opening of said cover will seat on said top of said tee; and wherein said tee, said tee holder, said cylinder, said cover, and said housing are adapted, in the presence of a source of positive air pressure within said predetermined range of magnitude, to provide a force which, when a golf ball is seated on said tee, is sufficient to raise said tee holder and said tee with the golf ball seated thereon to said raised position in said cylinder without blowing the golf ball off of said tee.

8. A teeing device according to claim 7, wherein said raised position of said tee holder is defined by the point of abutting of said tee holder with said cover.

9. A teeing device according to claim 7, wherein said tee, said tee holder, said cylinder, said cover, and said housing are further adapted, in the presence of the source of positive air pressure within said predetermined range of magnitude, to provide a force which, when there is no golf ball seated on said tee, is not sufficient to raise said tee holder and said tee above said lowered position.

10. A teeing device according to claim 7, further including a mechanical stop located in the wall of said cylinder which defines said lowered position, in said cylinder, of said tee holder with said tee mounted therein.

11. A teeing device according to claim 7, wherein said cover includes a substantially horizontal driving surface which has an indentation configured to gravitationally direct a golf ball to said opening of said cover to seat on said tee.

12. A teeing device according to claim 11, wherein said horizontal driving surface of said cover includes a top layer of artificial turf.

13. A teeing device according to claim 7, further including air pressure regulating apparatus to ensure that the positive air pressure introduced therein is of a magnitude which falls within said predetermined range.

14. A teeing device according to claim 8, wherein said cover further includes a height adjustment mechanism adapted to adjust the height of said point of abutting of said tee holder and said cover.

15. A teeing device according to claim 7, wherein said source of positive air pressure is a fan.

16. A teeing device according to claim 7, wherein said predetermined loading is provided in response to the positioning of a golf ball on said tee.

17. A teeing device according to claim 7, wherein said hollow tee, said tee holder and said cylinder are supported by said cover, so as to be removable from said housing together therewith.

18. A teeing device according to claim 7, wherein said cover is formed with an upwardly extending rim, thereby to prevent the ingress of surface water into the interior of said container, up to a depth corresponding to the height of said rim.

19. A teeing device according to claim 7, and also including means for minimizing noise produced by the air flow within said housing.

20. A teeing device according to claim 7, and wherein said air inlet port is configured to direct an air flow into said housing in a manner that minimizes the noise produced thereby.

* * * * *